US007723417B2

(12) United States Patent
Coppens et al.

(10) Patent No.: US 7,723,417 B2
(45) Date of Patent: May 25, 2010

(54) FLUOROCHEMICAL COMPOSITION AND METHOD FOR TREATING A SUBSTRATE THEREWITH

(75) Inventors: Dirk M. Coppens, Melsele (BE); Dean M. Moren, North St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1238 days.

(21) Appl. No.: 10/808,902

(22) Filed: Mar. 25, 2004

(65) Prior Publication Data

US 2005/0211945 A1 Sep. 29, 2005

(51) Int. Cl.
*C08K 5/09* (2006.01)

(52) U.S. Cl. ..... 524/306; 524/308; 524/309; 524/317; 524/544

(58) Field of Classification Search ..... 524/306, 524/308, 309, 317, 544
See application file for complete search history.

(56) References Cited

U.S. PATENT DOCUMENTS 3,660,360 A 5/1972 Ray-Chaudhuri
3,895,029 A * 7/1975 Ward ..... 524/317
4,742,140 A 5/1988 Greenwood et al.
5,284,902 A 2/1994 Huber et al.
5,876,617 A 3/1999 Sato et al.
5,910,557 A 6/1999 Audenaert et al.
5,977,228 A * 11/1999 Mauer ..... 524/284
6,121,372 A 9/2000 Yamamoto et al.
6,126,849 A 10/2000 Yamana et al.
6,380,336 B1 * 4/2002 Soane et al. ..... 526/245
6,525,127 B1 2/2003 Jariwala et al.

FOREIGN PATENT DOCUMENTS

EP 1 329 548 7/2003

OTHER PUBLICATIONS

Blocked Isocyanates III.: Part. A, Mechanisms and chemistry by Douglas Wicks and Zeno W. Wicks Jr., *Progress in Organic Coatings*, 36 (1999), pp. 14-172.
Test Method 22-1996, published in the 2001 Technical Manual of the American Association of Textile Chemists and Colorists (AATCC).
American Association of Textile Chemists and Colorists (AATCC) Standard Test Method No. 118-1983.

* cited by examiner

*Primary Examiner*—Peter D Mulcahy
(74) *Attorney, Agent, or Firm*—Lisa P. Fulton

(57) ABSTRACT

The present invention provides an aqueous composition comprising (i) a fluorochemical compound and (ii) an ester derivative of an alpha-hydroxy acid, the ester derivative having a melting point of not more than 35° C. and a water solubility of not more than 10% by weight at 25° C. The fluorochemical compound is typically dispersed or emulsified in the aqueous composition. The aqueous compositions may provide such advantages as providing good oil- and/or water repellency properties to a substrate upon application at ambient conditions, without the need for a heat treatment. Thus, the aqueous compositions may be used to provide oil- and/or water repellency properties to a substrate such as for example a fibrous substrate, e.g., leather or textile. In particular, repellency properties comparable to those achieved with a heat treatment step may be achieved.

10 Claims, No Drawings

FLUOROCHEMICAL COMPOSITION AND METHOD FOR TREATING A SUBSTRATE THEREWITH

FIELD OF THE INVENTION

The present invention relates to an aqueous composition of a fluorochemical compound and to a method of treatment of a substrate with the aqueous composition. The present invention relates in particular to aqueous compositions that can be applied to a substrate and dried at ambient temperature, thus avoiding the need for a heat treatment.

BACKGROUND

Compositions for making substrates, e.g., fibrous substrates such as leather and textiles, oil- and water repellent and/or to provide other properties such as stain repellency and/or stain release to the substrate have been long known in the art. Fluorochemical compounds have been well known as being highly effective in providing oil and water repellency to substrates and in particular textile and leather substrates. A variety of fluorochemical compositions are known and have been used to render substrates oil- and/or water repellent as well as to provide stain resistance or stain release properties thereto. For example, the fluorochemical composition may be based on fluorochemical acrylates or methacrylates that are derived from the polymerization of an acrylate or methacrylate monomer that has a fluorinated group and optionally one or more non-fluorinated monomers. Such compositions have been described in for example U.S. Pat. No. 3,660,360, U.S. Pat. No. 5,876,617, U.S. Pat. No. 4,742,140, U.S. Pat. No. 6,121,372 and U.S. Pat. No. 6,126,849 and EP 1 329 548.

Alternatively, the fluorochemical compound contained in the fluorochemical composition may be derived from a condensation reaction of a fluorochemical compound having an isocyanate reactive group such as, e.g., a hydroxy group and a polyisocyanate compound and optional non-fluorinated co-reactants as disclosed in, e.g., U.S. Pat. No. 5,910,557.

U.S. Pat. No. 6,525,127 discloses fluorochemical compositions that are based on a fluorochemical compound comprising: a fluorochemical oligomeric portion comprising an aliphatic backbone with a plurality of pendant fluoroaliphatic groups, each fluoroaliphatic group having a fully fluorinated terminal group and each independently linked to a carbon atom of the aliphatic backbone through an organic linking group; an aliphatic moiety; and a linking group which links the fluorochemical oligomeric portion to the aliphatic moiety. The compositions are taught to provide desirable oil, water and stain repellency to fibrous substrates.

The known fluorochemical compositions are available both as solutions or dispersions in an organic solvent as well as aqueous based compositions wherein the fluorochemical composition is typically dispersed in an aqueous medium. Water based compositions are generally preferred from an environmental point of view.

One of the disadvantages of water based compositions is that they typically require a heat treatment at elevated temperature of, e.g., 60° C. or more upon application on a substrate to achieve optimal properties such as oil- and/or water repellency properties. Accordingly, such aqueous compositions are not very suitable for use by a consumer that wants to treat a substrate such as for example a leather jacket or a garment. Treatments carried out by consumers are typically done at room temperature, e.g., by spraying the composition on the substrate desired to be treated and then leaving that substrate to dry at ambient conditions.

It would now be desirable to improve aqueous based fluorochemical compositions. In particular it would be desired to develop aqueous compositions having a fluorochemical compound that can be applied at ambient conditions without the need of a heat treatment step while still achieving good repellency properties such as oil and/or water repellency properties on the substrate. Preferably the obtained repellency properties would be comparable to those achieved upon heat treatment. Desirably the composition is environmentally friendly and is substantially free of flammable compounds. It would furthermore be desirable that the compositions can be manufactured in an easy and convenient way and at economically favorable conditions. Desirably, the composition can be easily applied by a consumer such as for example by spraying, wiping or foaming the composition on a substrate. Desirably, the compositions are effective for treating fibrous substrates such as textiles and leathers.

SUMMARY OF THE INVENTION

The present invention provides in one aspect, an aqueous composition comprising (i) a fluorochemical compound and (ii) an ester derivative of an alpha-hydroxy acid, the ester derivative having a melting point of not more than 35° C. and a water solubility of not more than 10% by weight at 25° C. The fluorochemical compound is typically dispersed or emulsified in the aqueous composition.

The aqueous compositions may provide such advantages as providing good oil- and/or water repellency properties to a substrate upon application at ambient conditions, e.g., at a temperature between 15 and 35° C. or conveniently between 15 and 30° C., without the need for a heat treatment. Thus, the aqueous compositions may be used to provide oil- and/or water repellency properties to a substrate such as for example a fibrous substrate, e.g., leather or textile. In particular, repellency properties comparable to those achieved with a heat treatment step may be achieved. In particular embodiments, the aqueous compositions are cost effective. Also, the aqueous composition can generally be applied in an easy way using for example methods typically used by consumers. The compositions can conveniently be designed to avoid the need for flammable components such as organic solvents and may be designed in an environmentally friendly way.

In a further aspect, the present invention relates to a method of treatment comprising contacting a substrate with the aqueous composition.

In yet another aspect, the present invention provides a spray can containing the aqueous composition.

DETAILED DESCRIPTION OF ILLUSTRATIVE EMBODIMENTS OF THE INVENTION

Ester Derivative of Alpha-Hydroxy Acid

By the term "ester derivative of alpha-hydroxy acid" is meant a compound that can be obtained by esterification of the acid group or groups of the alpha-hydroxy acid as well as compounds in which the alpha-hydroxy group or groups of the alpha-hydroxy acid has been esterified, i.e., the alpha-hydroxy group has been replaced with an acyloxy group. If the alpha-hydroxy group has been replaced with an acyloxy group, the acid group or groups of the alpha-hydroxy acid may or may not have been esterified.

The ester derivative should have a water solubility of not more than 10% by weight and a melting point of not more than 35° C., for example not more than 30° C. Typically, the ester derivative will have a melting point of 25° C. or less. The water solubility of the ester derivative is typically determined at ambient conditions (25° C.) in demineralized water without the presence of other substances of the aqueous composition. Conveniently, the water solubility of the ester derivative is not more than 8% and in particular embodiments of the invention, the water solubility can be 5% or less. The ester derivative may be essentially water insoluble or have very low water solubility as long as the ester derivative can be readily incorporated into the aqueous composition without irreversibly precipitating therefrom. The ester derivative is generally a carboxylic acid ester.

The ester derivative in one embodiment of the present invention further has a vapor pressure determined at 20° C. of not more than 0.03 kPa and/or the ester derivative has a boiling point at a pressure of 1 atm of at least 150° C., for example at least 240° C. or at least 290° C.

The ester derivative may be an aliphatic or aromatic ester, i.e., the ester groups may contain aliphatic and/or aromatic groups. Aliphatic ester groups of the ester derivative may be linear, branched or contain cyclic structure. Generally, the aliphatic ester groups should be saturated although unsaturated aliphatic ester groups are not excluded. In a particular embodiment of the invention, the ester derivative is an ester of alpha-hydroxy acid that has at least two acid groups, in particular carboxylic acid groups. When the ester derivative is an ester of such a polyacid, all of the acid groups will be esterified although polyacids in which only one or not all of the acid groups have been esterified are not intended to be excluded provided they meet the requirements of water solubility and melting point as aforementioned. Compounds in which all of the acid groups are esterified typically should have a total number of carbon atoms in the ester groups of at least 4, for example at least 6. In addition to the esterification of the acid groups in such polyacids, the alpha-hydroxy group in the compound may have been esterified as well, i.e. having been replaced with an acyloxy group.

In a particular embodiment, the ester derivative is selected from esters corresponding to the following general formula:

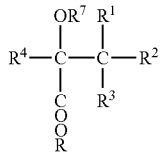

(I)

wherein each of $R^1$, $R^2$ and $R^3$ independently represents H, OH, a hydrocarbon group such as for example an aliphatic group including a linear or branched alkyl group, or $COOR^5$ with $R^5$ representing a hydrocarbon group such as for example an aliphatic group including linear or branched alkyl groups; $R^4$ represents H, a hydrocarbon group such as for example an aliphatic group including a linear or branched alkyl group or —$CH_2$—$COOR^6$ wherein $R^6$ represents a hydrocarbon group such as for example an aliphatic group including linear or branched alkyl groups; R represents a hydrocarbon group such as for example an aliphatic group including linear or branched alkyl groups; and $R^7$ represents H or an acyl group. The acyl group typically corresponds to the formula $R^8$—CO wherein $R^8$ represents a hydrocarbon group such as an aliphatic group including linear or branched alkyl groups. R, $R^5$, $R^6$ and $R^8$ typically each independently represent an aliphatic group, in particular an alkyl group, having from 1 to 10 carbon atoms and conveniently from 1 to 5 carbon atoms. When $R^1$, $R^2$, $R^3$ or $R^4$ represents an aliphatic group, that aliphatic group will typically have from 1 to 10 carbon atoms, typically from 1 to 5 carbon atoms.

Compounds according to formula (I) include for example citrates, tartarates, and malates. Examples of ester derivatives that may be used with the aqueous composition according to this invention include alkyl citrates, alkyl tartarates, and alkyl malates. Particular compounds include triethyl citrate, tributyl citrate, dibutyl malate, dibutyl tartarate, acetyl triethyl citrate, and acetyl tributyl citrate.

One ester derivative or a mixture thereof may be used in the aqueous composition. Typically, the ester derivative (total amount) should be used in an amount of 0.1 to 20% by weight, conveniently in an amount of 0.5 to 10% by weight.

Fluorochemical Compound

Any of the well-known fluorochemical compounds that are capable of imparting water and/or oil repellency can be used in the compositions of the invention. Suitable fluorochemical compounds include any of the fluorochemical group-containing organic compounds including polymeric and non-polymeric compounds that may impart water and oil repellency to substrates. The term 'polymeric' as used in this invention is intended to include both high molecular weight compounds as well as low molecular weight compounds which are sometimes called oligomeric compounds in the art. The fluorochemical compounds typically comprise one or more fluorochemical groups that contain a perfluorinated carbon chain having from 3 to about 20 carbon atoms, typically from about 4 to about 14 carbon atoms. The fluorochemical groups can contain straight chain, branched chain, or cyclic fluorinated alkylene groups or any combination thereof. The fluorochemical groups are preferably free of polymerizable olefinic unsaturation but can optionally contain catenary (i.e., in-chain, bonded only to carbon) heteroatoms such as oxygen, divalent or hexavalent sulfur, or nitrogen. Fully-fluorinated groups are preferred, but hydrogen or chlorine atoms can also be present as substituents, provided that no more than one atom of either is present for every two carbon atoms. It is additionally preferred that any fluorochemical group contain from about 40% to about 80% fluorine by weight, more preferably about 50% to about 78% fluorine by weight. The terminal portion of the group is generally fully-fluorinated, preferably containing at least 7 fluorine atoms. Perfluorinated aliphatic groups (i.e., those of the formula $C_nF_{2n+1}$—) are the most preferred fluorochemical groups.

Representative examples of suitable fluorochemical compounds include fluorochemical urethanes, ureas, esters, ethers, alcohols, epoxides, allophanates, amides, amines (and salts thereof), acids (and salts thereof), carbodiimides, guanidines, oxazolidinones, isocyanurates, biurets, acrylate and methacrylate homopolymers and copolymers, and mixtures thereof.

In an embodiment of this invention, the fluorochemical compound may comprise a polymer derived from the polymerization of a fluorinated monomer according to the formula:

$$R_f\text{—X-E} \qquad \text{(II)}$$

wherein $R_f$ represents a perfluorinated aliphatic group for example having 3 to 12 carbon atoms, X represents an organic linking group and E represents an ethylenically unsaturated group. E is typically an ethylenically unsaturated group that does not contain fluorine atoms. In a particular embodiment, the perfluorinated aliphatic group has 3 or 4 carbon atoms.

Linking group X is generally non-fluorinated and preferably contains from 1 to about 20 carbon atoms. X can optionally contain oxygen, nitrogen, or sulfur-containing groups or a combination thereof, and X is free of functional groups that substantially interfere with free-radical polymerization (e.g., polymerizable olefinic double bonds, thiols, and other such functionality known to those skilled in the art). Examples of suitable linking groups X include straight chain, branched chain or cyclic alkylene, arylene, aralkylene, sulfonyl, sulfoxy, sulfonamido, carbonamido, carbonyloxy, urethanylene, ureylene, and combinations thereof such as sulfonamidoalkylene.

Generally, the fluorinated monomer according to formula (II) is copolymerized with a non-fluorinated monomer such as the non-fluorinated monomers disclosed below, in particular those corresponding to formula (IV) below.

Representative fluorochemical group-containing polymers useful in the present invention include fluorochemical acrylate and methacrylate homopolymers or copolymers containing fluorochemical acrylate monomers interpolymerized with monomers such as methyl methacrylate, butyl acrylate, octadecyl methacrylate, acrylate and methacrylate esters of oxyalkylene and polyoxyalkylene polyol oligomers (e.g., diethylene glycol dimethacrylate, polyethylene glycol dimethacrylate, polyethylene oxide diacrylate, and polyethylene glycol monoacrylate), glycidyl methacrylate, ethylene, butadiene, styrene, isoprene, chloroprene, vinyl acetate, vinyl chloride, vinylidene chloride, vinylidene fluoride, acrylonitrile, vinyl chloroacetate, vinylpyridine, vinyl alkyl ethers, vinyl alkyl ketones, acrylic acid, methacrylic acid, 2-hydroxyethyl acrylate, N-methylolacrylamide, 2-(N,N,N-trimethylammonium)ethyl methacrylate, and 2-acrylamido-2-methylpropanesulfonic acid (AMPS). The relative amounts of various comonomers used can generally be selected empirically, depending on the substrate to be treated, the properties desired, and the mode of application to the substrate.

In one particular embodiment, the fluorochemical compound comprises a fluorinated polymer comprising fluorinated repeating units derived from fluorinated monomers corresponding to the formula:

$$R^1_f—X^1—OC(O)—C(R)=CH_2 \quad \text{(III)}$$

wherein $R^1_f$ represents a perfluorinated aliphatic group for example having 3 or 4 carbon atoms, $X^1$ is an organic divalent linking group, and R represents hydrogen or a lower alkyl group having 1 to 4 carbon atoms.

The linking group $X^1$ links the perfluoroaliphatic group $R^1_f$ to the free radical polymerizable group and may be one of the linking groups described for X above.

Specific examples of fluorinated monomers include:

$$CF_3CF_2CF_2CF_2CH_2CH_2OCOCR^1=CH_2$$

$$CF_3(CF_2)_3CH_2OCOCR^1=CH_2$$

$$CF_3(CF_2)_3SO_2N(CH_3)CH_2CH_2OCOCR^1=CH_2$$

$$CF_3(CF_2)_3SO_2N(C_2H_5)CH_2CH_2OCOCR^1=CH_2$$

$$CF_3(CF_2)_3SO_2N(CH_3)CH_2CH(CH_3)OCOCR^1=CH_2$$

$$(CF_3)_2CFCF_2SO_2N(CH_3)CH_2CH_2OCOCR^1=CH_2$$

wherein $R^1$ is hydrogen or methyl.

The fluorinated monomer according to formula (II) or (III) or mixture thereof is typically used in amounts such that the amount of the corresponding units thereof in the polymer is between 10 and 97 mole %, preferably between 25 and 97 mole %, more preferably between 25 mole % and 85 mole %, most preferably between 25 mole % and 75 mole %.

The fluorinated monomer is generally copolymerized with one or more non-fluorinated monomers. In one embodiment, at least part of the non-fluorinated monomers is selected from chlorine containing monomers such as vinyl chloride and vinylidene chloride. Repeating units of such chlorine containing monomers, when present, are preferably contained in the fluorinated polymer in an amount between 3 and 75 mole %.

Further non-fluorinated comonomers, other than the chlorine containing monomers referred to above, include hydrocarbon group containing monomers such as monomers that can be represented by formula:

$$R_h\text{-L-Z} \quad \text{(IV)}$$

wherein $R_h$ represents an aliphatic group having 4 to 30 carbon atoms, L represents an organic divalent linking group and Z represents an ethylenically unsaturated group. The hydrocarbon group is preferably selected from the group consisting of a linear, branched or cyclic alkyl group, an aralkyl group, an alkylaryl group and an aryl group. Further non-fluorinated monomers include those wherein the hydrocarbon group in formula (IV) includes oxyalkylene groups or substituents, such as hydroxy groups and/or cure sites.

Examples of non-fluorinated comonomers include hydrocarbon esters of an α,β-ethylenically unsaturated carboxylic acid. Examples include n-butyl (meth)acrylate, isobutyl (meth)acrylate, octadecyl (meth)acrylate, lauryl (meth)acrylate, cyclohexyl (meth)acrylate, cyclodecyl (meth)acrylate, isobornyl (meth)acrylate, phenyl (meth)acrylate, benzyl (meth)acrylate, adamantyl (meth)acrylate, tolyl (meth)acrylate, 3,3-dimethylbutyl (meth)acrylate, (2,2-dimethyl-1-methyl)propyl (meth)acrylate, cyclopentyl (meth)acrylate, 2-ethylhexyl (meth)acrylate, t-butyl (meth)acrylate, cetyl (meth)acrylate, stearyl (meth)acrylate, behenyl (meth)acrylate, isooctyl (meth)acrylate, n-octyl (meth)acrylate, 4-ethylcyclohexyl (meth)acrylate, 2-ethoxyethyl methacrylate and tetrahydropyranyl acrylate. Further non-fluorinated comonomers include allyl alcohol and its esters such as allyl glycolate, allyl acetate and allyl heptanoate; alkyl vinyl ethers or alkyl allyl ethers such as cetyl vinyl ether, dodecylvinyl ether, ethylvinyl ether; unsaturated acids such as acrylic acid, methacrylic acid, alpha-chloro acrylic acid, crotonic acid, maleic acid, fumaric acid, itaconic acid and their anhydrides and their esters such as vinyl, allyl, methyl, butyl, isobutyl, hexyl, heptyl, 2-ethylhexyl, cyclohexyl, lauryl, stearyl, isobornyl, 2-cyanoethyl acrylate or alkoxyethyl acrylates and methacrylates; alpha-beta unsaturated nitriles such as acrylonitrile, methacrylonitrile, 2-chloroacrylonitrile, alkyl cyanoacrylates; alpha,beta-unsaturated carboxylic acid derivatives such as acrylamide, methacrylamide, N,N-diisopropyl acrylamide, diacetoneacrylamide; aminoalkyl (meth)acrylates such as N,N-diethylaminoethyl methacrylate, N-t-butylaminoethyl methacrylate; alkyl (meth)acrylates having an ammonium group such as (meth)acrylates of the formula $Z^-R_3N^+—R^a—OC(O)—CR^1=CH_2$ wherein $Z^-$ represents an anion such as e.g. a chloride anion, R represents hydrogen or an alkyl group and each R may be the same or different, $R^a$ represents an alkylene and $R^1$ represents hydrogen or methyl; styrene and its derivatives such as vinyl toluene, alpha-methylstyrene, alpha-cyanomethylstyrene; lower olefinic hydrocarbons which can contain halogen such as ethylene, propylene, isobutene, 3-chloro-1-isobutene, butadiene, isoprene, chloro and dichlorobutadiene and 2,5-dimethyl-1,5-hexadiene, hydrocarbon monomers comprising (poly)oxyalkylene groups including (meth)acrylates of a polyethylene glycol, (meth)acrylates of a block copolymer of ethylene oxide and propylene oxide, (meth)acrylates of amino- or diamino terminated polyethers and (meth)acrylates of methoxypolyethyleneglycols and hydrocarbon monomers comprising a hydroxyl group include hydroxyl group containing (meth) acrylates, such as hydroxyethyl (meth)acrylate and hydroxypropyl(meth)acrylate.

In a particular embodiment of the invention, the fluorinated polymer comprising units deriving from a monomer according to formula (II) or (III) further includes units having one or more cure sites. These units will typically derive from corresponding comonomers that include one or more cure sites. By the term 'cure site' is meant a functional group that is capable of engaging in a reaction with the substrate to be treated. Examples of cure sites include acid groups such as carboxylic acid groups, hydroxy groups, amino groups and isocyanate groups or blocked isocyanate groups. Examples of comonomers from which a cure site unit may derive include (meth) acrylic acid, maleic acid, maleic anhydride, allyl methacrylate, hydroxybutyl vinyl ether, N-hydroxymethyl (meth) acrylamide, N-methoxymethyl acrylamide, N-butoxymethyl acrylamide, N-isobutoxymethyl acrylamide, glycidylmethacrylate and α,α dimethyl-3-isopropenyl benzyl isocyanate. Other examples include polymerizable urethanes, that can be obtained by the reaction of a polymerizable monoisocyanate with an isocyanate blocking agent or by the reaction of a di- or poly-isocyanate and a hydroxy or amino-functionalized acrylate or methacrylate and an isocyanate blocking agent. Isocyanate blocking agents are compounds that upon reaction with an isocyanate group yield a group that is unreactive at room temperature with compounds that at room temperature normally react with an isocyanate but which group at elevated temperature reacts with isocyanate reactive compounds. Generally, at elevated temperature the blocking group will be released from the blocked (poly)isocyanate compound thereby generating the isocyanate group again which can then react with an isocyanate reactive group. Blocking agents and their mechanisms have been described in detail in "Blocked isocyanates III.: Part. A, Mechanisms and chemistry" by Douglas Wicks and Zeno W. Wicks Jr., *Progress in Organic Coatings*, 36 (1999), pp. 14-172.

The blocked isocyanate may be aromatic, aliphatic, cyclic or acyclic and is generally a blocked di- or triisocyanate or a mixture thereof and can be obtained by reacting an isocyanate with a blocking agent that has at least one functional group capable of reacting with an isocyanate group. Preferred blocked isocyanates are blocked polyisocyanates that at a temperature of less than 150° C. are capable of reacting with an isocyanate reactive group, preferably through deblocking of the blocking agent at elevated temperature. Preferred blocking agents include aryl alcohols such as phenols, lactams such as ε-caprolactam, δ-valerolactam, γ-butyrolactam, oximes such as formaldoxime, acetaldoxime, cyclohexanone oxime, acetophenone oxime, benzophenone oxime, 2-butanone oxime or diethyl glyoxime. Particular examples of comonomers having a blocked isocyanate group as the cure site include the reaction product of a di-isocyanate, 2-hydroxyethyl(meth)acrylate and 2-butanone oxime or the reaction product of a di-isocyanate, a mono(meth)acrylate of a polyethylene glycol and 2-butanone oxime and the reaction product of a triisocyanate, 1 equivalent of 2-hydroxyethyl (meth)acrylate and 2 equivalents of 2-butanone oxime and the reaction product of α,α-dimethyl m. isopropenyl benzyl isocyanate with 2-butanone oxime.

In yet a further embodiment in connection with the present invention, the fluorochemical compound used in the composition is an alkylated fluorochemical oligomer as disclosed in U.S. Pat. No. 6,525,127. The alkylated fluorochemical oligomers disclosed in this US patent comprise:

(i) a fluorochemical oligomeric portion comprising an aliphatic backbone with a plurality of fluoroaliphatic groups attached thereto, each fluoroaliphatic group having a fully fluorinated terminal group and each independently linked to a carbon atom of the aliphatic backbone through an organic linking group;

(ii) an aliphatic moiety having at least 12 carbon atoms; and (iii) a linking group which links the fluorochemical oligomeric portion to the aliphatic moiety.

In a still further embodiment in connection with the present invention, the fluorochemical compound is one that can be obtained by reacting an isocyanate, in particular a polyisocyanate and a fluorinated compound having one or more isocyanate reactive groups such as for example a hydroxyl group, a thiol or an amino group. Alternatively, the fluorochemical compound can be one that may be obtained from a reaction of a fluorinated compound having one or more isocyanate groups and a non-fluorinated compound having one or isocyanate reactive groups. When the fluorochemical compound derives from an isocyanate condensation reaction, the condensation reaction may involve co-reactants that are non-fluorinated. For example, the fluorochemical compound may be derived from the condensation reaction of a fluorinated compound having one or more isocyanate reactive groups, an isocyanate such as a polyisocyanate and one or more non-fluorinated compounds that have isocyanate reactive groups. In a particular embodiment, the fluorinated compound having isocyanate reactive groups may be obtained by the polymerization of a fluorinated monomer such as disclosed above and optionally a non-fluorinated comonomer in the presence of a chain transfer agent that contains one or more isocyanate reactive groups in addition to the functional group active in the chain transfer reaction. Examples of such chain transfer agents include those that have thiol group and further one or more hydroxyl or amino groups. Typical examples of such chain transfer agents include 2-mercaptoethanol, 3-mercapto-2-propanol, 3-mercapto-1-propanol, 3-mercapto-2-butanol and 2-mercaptoethylamine.

The fluorochemical compound or mixture of such compound is typically contained in the aqueous composition in an amount of up to 50% by weight, typically in an amount of 1 to 30% by weight. Generally, the fluorochemical compound will be dispersed in the aqueous medium of the composition with the aid of a surfactant or emulsifier. Suitable surfactants include anionic, cationic, zwitter-ionic, amphoteric as well as non-ionic surfactants. A mixture of surfactants may be used as well with the understanding that surfactants of opposite charge should generally not be used in admixture. Commercially available surfactants that can be used include Arquad™ T-50, Arquad™ MCB-50, Ethoquad™ C-12 and Ethoquad™ 18-25 from Akzo-Nobel. Generally, the surfactant will be used in an amount of 0.01% to 1%, preferably in an amount of 0.05 to 0.5% based on total weight of the aqueous composition.

Optional Further Additives

The aqueous composition may contain further additives in order to achieve particular effects or properties of the composition. Generally, the aqueous composition will have a pH of 3 to 10 and the composition may contain buffering agents. The composition may also contain so-called extender compounds. Extenders are typically non-fluorinated compounds that improve the efficiency of the fluorochemical compound in the composition to provide the desired repellency properties such that either a lower amount of the fluorochemical compound can be used or improved repellency properties are obtained. Examples of extender compounds, include siloxanes, (meth)acrylate and substituted acrylate polymers and copolymers, N-methylolacrylamide-containing acrylate polymers, urethanes, blocked isocyanate-containing polymers and oligomers, condensates or precondensates of urea or melamine with formaldehyde, glyoxal resins, condensates of fatty acids with melamine or urea derivatives, condensates of fatty acids with polyamides and their epichlorohydrin adducts, waxes, polyethylene, chlorinated polyethylene, alkyl ketene dimers, esters, and amides. Blends of these fluorine-free extender compounds can also be used. When present, the extender compounds can be comprised in the composition in an amount of 0.1 to 10%, generally 0.5 to 5%.

Still further additives that can be used include touch modifiers, such as, e.g., dispersed oils, fats, silicones or polyethylene; matting agents, such as, e.g., silica and waxes; polishing agents, such as, e.g., silicones and waxes.

The composition of the invention will typically have a total amount of solids of 0.5 to 40% by weight. The fluorochemical compound generally comprises 10% to 99% of the solids. A composition ready for use in a treatment of a substrate will generally have between 0.25 and 10% by weight of solids. Compositions having a higher amount of solids can be used as concentrates and are conveniently diluted with water prior to use in a treatment method.

Method of Treatment

The composition of the invention can be used to treat a substrate, in particular a fibrous substrate to render it oil- and/or water repellent and/or to provide stain repellency or stain release properties thereto. Fibrous substrates that may be treated with the composition include textile, non-woven substrates, carpet and leather. The fibrous substrate may be based on synthetic fibers including for example polyester fibers, acrylic fibers and polyamide fibers as well as natural fibers such as cellulose fibers. The fibrous substrate may further comprise a mixture of different fibers including mixtures of synthetic and natural fibers as for example a mixture of polyester and cellulose fibers or mixtures of synthetic fibers such as a mixture of polyester and polyamide fibers. In a particular embodiment, the substrate may also be a hard surface substrate such as for example plastic, glass and porous hard surface substrates such as for example terracotta, stone and concrete although the invention will be most useful for the treatment of soft surface substrates such as fibrous substrates including leather and textiles.

The composition is generally applied to a substrate in an amount effective to obtain a desired level of oil- and/or water repellency properties. Typically, for textile substrates, the composition should be applied in an amount such that the amount of fluorochemical compound on the substrate is between 0.1 and 3% by weight based on the weight of the substrate, preferably between 0.2 and 1% by weight. In case of other substrates such as leather or porous hard surface substrates the amounts are conveniently between 0.1 to 10 g solids per square meter. The composition may be applied by any of the application techniques used to apply fluorochemical compositions to a substrate, in particular a fibrous substrate. However, the aqueous composition is particularly suitable for application by spraying, for example from a spray can including the composition. Suitable spray cans may or may not include a propellant. When the spray can includes a propellant it can be selected from for example carbon dioxide, halogenated propellants, dimethyl ether and propane butane. The nozzle of the spray can will typically be selected as a function of the desired application, e.g., foaming or not, and whether or not the can includes a propellant or not. Cans that can be used include those that are commercially available from, e.g., Sara Lee, Punch and Melvo.

Alternatively, the composition may be wiped or brushed on the substrate or the composition may be foamed and applied to the substrate. In the latter case, the composition may additionally contain a foaming agent and may be applied from a spray can having an appropriate nozzle to cause foaming of the composition. Still further, the composition may be applied by roll coating.

Following application of the composition to the substrate, the substrate will generally be dried. The substrate may be dried at ambient conditions by leaving the substrate exposed to air for a certain period of time. Compositions according to the invention will typically provide good repellency properties under such conditions and the use of a heat treatment will generally not be necessary. Nevertheless, the use of heat treatment is not excluded.

The invention is further illustrated with reference to the following examples without however the intention to limit the invention thereto.

EXAMPLES

In the examples and comparative examples, all percentages are by weight, unless otherwise specified.

Test Methods

The water solubility of an additive was determined at ambient conditions (25° C.) in demineralized water. Measured quantities of additive and demineralized water were combined and shaken for up to two hours. The additive was deemed soluble if a clear solution resulted; the additive was otherwise deemed insoluble. The water solubility of an additive is the maximum concentration of additive producing a clear solution in water. For example, if at most one gram additive will dissolve in 9 grams water, the water solubility of the additive is defined as 10% by weight.

Spray Rating (SR)

The spray rating of a treated substrate is a value indicative of the dynamic repellency of the treated substrate to water that impinges on the treated substrate. The repellency was measured by Test Method 22-1996, published in the 2001 Technical Manual of the American Association of Textile Chemists and Colorists (AATCC), and was expressed in terms of a 'spray rating' of the tested substrate. The spray rating was obtained by spraying 250 ml water on the substrate from a height of 15 cm. The wetting pattern was visually rated using a 0 to 100 scale, where 0 means complete wetting and 100 means no wetting at all.

Oil Repellency (OR)

The oil repellency of a substrate was measured by the American Association of Textile Chemists and Colorists (AATCC) Standard Test Method No. 118-1983, which test was based on the resistance of a treated substrate to penetration by oils of varying surface tensions. Treated substrates resistant only to Nujol® mineral oil (the least penetrating of the test oils) were given a rating of 1, whereas treated substrates resistant to heptane (the most penetrating of the test liquids) were given a rating of 8. Other intermediate values were determined by use of other pure oils or mixtures of oils, as shown in the following table.

| Standard Test Liquids | |
|---|---|
| AATCC Oil Repellency Rating Number | Compositions |
| 1 | Nujol ® |
| 2 | Nujol ®/n-Hexadecane 65/35 |
| 3 | n-Hexadecane |
| 4 | n-Tetradecane |
| 5 | n-Dodecane |
| 6 | n-Decane |
| 7 | n-Octane |
| 8 | n-Heptane |

Water Repellency Test (WR)

The water repellency (WR) of a substrate was measured using a series of water-isopropyl alcohol test liquids and was expressed in terms of the "WR" rating of the treated substrate. The WR rating corresponded to the most penetrating test liquid which did not penetrate or wet the substrate surface after 15 seconds exposure. Substrates which were penetrated by or were resistant only to 100% water (0% isopropyl alcohol), the least penetrating test liquid, were given a rating of 0, whereas substrates resistant to 100% isopropyl alcohol (0% water), the most penetrating test liquid, were given a rating of 10. Other intermediate ratings were calculated by dividing the percent isopropylalcohol in the test liquid by 10, e.g., a treated substrate resistant to a 70%/30% isopropyl alcohol/water blend, but not to an 80%/20% blend, would be given a rating of 7.

Abraded Oil (AOR) and Water Repellency (AWR)

The repellency of an abraded treated substrate was measured on 5 cm×12.5 cm test pieces of treated substrate which had been abraded using 10 back-and-forth rubs over a 5-second period with abrasive paper ("WETORDRY-TRI-M-ITE" No. 600C) in an AATCC crockmeter (Model CM-1). The above-described OR and WR repellency tests were performed on the abraded test pieces and the repellency ratings recorded as Abraded Oil Repellency (AOR) and Abraded Water Repellency (AWR) values.

Abbreviations:

PM 4700: anionic FC acrylate polymer, commercially available from 3M

PM 1650: anionic FC urethane polymer, commercially available from 3M

Nuva® LB: cationic fluoropolymer dispersion, commercially available from Clariant

| List of additives used in the examples and comparative examples | | | | |
|---|---|---|---|---|
| Name | Abbre-viation | Melting point (° C.) | Solubility $H_2O$ (w %) | Chemical class* |
| Ester derivatives of α-hydroxy acid | | | | |
| Triethyl citrate | TEC | <22° C. | 6.9 | α-hydroxy ester |
| Tributyl citrate | TBC | <22° C. | <0.05 | α-hydroxy ester |
| Dibutyl malate | DBM | <22° C. | 0.2 | α-hydroxy ester |
| Dibutyl tartarate | DBT | <22° C. | 0.8 | α-hydroxy ester |
| Acetyl triethyl citrate | ATEC | <22° C. | <0.1 | α-acetyl ester |
| Acetyl tributyl citrate | ATBC | <22° C. | <0.1 | α-acetyl ester |
| Comparative additives | | | | |
| Diisopropyl tartarate | DIPT | <22° C. | >10 | α-hydroxy ester |
| Trimethyl citrate | TMC | 79° C. | 6 | α-hydroxy ester |
| Diethyl malate | DEM | <22° C. | >10 | α-hydroxy ester |
| Glycerol dimethacrylate | GDM | <22° C. | 0.4 | β-hydroxy ester |
| Dowanol ® TPnB $C_4H_9(OC_3H_6)_3$—OH | DTPnB | <22° C. | 3 | hydroxyl ether |

*By α-hydroxy ester is meant an ester derivative of an α-hydroxy acid

Examples 1 to 4 and Comparative Example C-1

In examples 1 to 4 aqueous compositions containing PM 4700 (3% solids) and various levels of TEC as indicated in table 1, were sprayed (2 crosses) onto blue nubuck leather (available from TFL) at approximately 110 g/m$^2$. In comparative example C-1, an aqueous composition of 3% PM 4700, without addition of TEC was sprayed onto the leather. The treated leathers were dried for 24 hours at a constant temperature of 21° C. After drying, the treated samples were cured at 60° C. during 3 min. The samples were tested for their oil and water repellency properties after drying at 21° C. (RT) and after curing (60° C.). The results are given in table 1.

TABLE 1 properties of blue nubuck leather, treated with fluorochemical/TEC compositions

| Ex | % | OR | | WR | | AOR | | AWR | | SR | |
|---|---|---|---|---|---|---|---|---|---|---|---|
| No | TEC | RT | 60° C. | RT | 60° C. | RT | 60° C. | RT | 60° C. | RT | 60° C. |
| 1 | 1 | 2 | 5 | 2 | 9 | 2 | 4 | 2 | 6 | 70 | 70 |
| 2 | 2 | 3 | 5 | 2 | 9 | 3 | 4 | 4 | 8 | 70 | 70 |
| 3 | 4 | 5 | 5 | 6 | 9 | 4 | 5 | 7 | 7 | 70 | 70 |
| 4 | 6 | 5-6 | 5 | 8 | 9 | 5 | 5 | 8 | 8 | 70 | 70 |
| C-1 | 0 | 1 | 5 | 1 | 9 | 2 | 5 | 3 | 8 | 70 | 70 |

The results in the table indicate that substrates treated with an aqueous fluorochemical composition comprising TEC had good oil and water repellency properties after drying at ambient temperature, without the need for a heat treatment step. Furthermore, it has been noticed that the treating compositions comprising TEC had improved wetting properties. The feel and appearance of the treated leather samples was excellent.

Examples 5 to 13 and Comparative Examples C-2 to C-10

In examples 5 to 13, different leather samples, as given in table 2 and available from TFL, were sprayed at 110 g/m$^2$ with an aqueous fluorochemical treating composition containing 3% solids PM 4700 and 6% TEC. In comparative examples C-2 to C-10, the leather samples were sprayed (110 g/m$^2$) with an aqueous composition of 3% PM 4700. The treated leather samples were dried at 21° C. during 24 hours. The performance results are given in table 2.

TABLE 2 performance results of leather treated with fluorochemical composition containing TEC

| Ex No | % TEC | substrate | OR | WR | AOR | AWR | SR |
|---|---|---|---|---|---|---|---|
| 5 | 6 | Nubuck upholstery (blue) | 5-6 | 8 | 5 | 8 | 100 |
| C-2 | 0 | Nubuck upholstery (blue) | 1 | 2 | 2 | 4 | 100 |
| 6 | 6 | Nubuck upholstery (grey) | 5-6 | 7 | 6 | 10 | 100 |
| C-3 | 0 | Nubuck upholstery (grey) | 2 | 2 | 2 | 2 | 100 |
| 7 | 6 | Nubuck upholstery (brown) | 6 | 10 | 6 | 8 | 100 |
| C-4 | 0 | Nubuck upholstery (brown) | 4 | 5 | 6 | 8 | 80 |
| 8 | 6 | Shoe full grain (dark brown) | 5-6 | 9 | 5 | 9 | 100 |
| C-5 | 0 | Shoe full grain (dark brown) | 0 | 2 | 1 | 1 | 100 |
| 9 | 6 | Pig skin suede (brown) | 6 | 9 | 6 | 10 | 100 |
| C-6 | 0 | Pig skin suede (brown) | 0 | 1 | 1 | 2 | 100 |
| 10 | 6 | Split upholstery (grey) | 6 | 10 | 6 | 10 | 100 |
| C-7 | 0 | Split upholstery (grey) | 1 | 3 | 2 | 7 | 100 |
| 11 | 6 | Shoe full grain (light brown) | 5 | 9 | 1 | 0 | 100 |
| C-8 | 0 | Shoe full grain (light brown) | 3 | 6 | 0 | 0 | 100 |
| 12 | 6 | Upholstery full grain (brown) | 2 | 9 | 2 | 9 | 100 |
| C-9 | 0 | Upholstery full grain (brown) | 2 | 8 | 4 | 9 | 100 |
| 13 | 6 | Sheep skin garment (crust) | 6 | 8 | 6 | 9 | 100 |
| C-10 | 0 | Sheep skin garment (crust) | 3 | 2 | 1 | 2 | 90 |

In all cases, it was observed that the addition of TEC to the fluorochemical composition improved the wetting properties of the treating composition. Furthermore, significant improvement in repellency properties was observed for a variety of different leather types, after treatment and drying at room temperature.

Examples 14 and 15 and Comparative Examples C-11 and C-12

In examples 14 and 15, various commercially available aqueous fluorochemical treating compositions were mixed with TEC (5%) before spray application onto blue nubuck leather, available from TFL (2 crosses, 110 g/m$^2$). Comparative examples C-11 and C-12 were made without addition of TEC. The treated samples were dried at 21° C. during 24 hours and tested for repellency properties. The results are given in table 3.

TABLE 3 performance of blue nubuck leather treated with fluorochemical composition

| Ex No | FC | OR | WR | AOR | AWR | SR |
|---|---|---|---|---|---|---|
| 14 | Nuva ® LB | 5 | 3 | 2 | 1 | 80 |
| C-11 | Nuva ® LB | 4 | 1 | 1 | 1 | 70 |
| 15 | PM1650 | 3 | 2 | 2 | 2 | 70 |
| C-12 | PM1650 | 0 | 0 | 0 | 0 | 70 |

The results indicated that the performance of commercially available fluorochemical treating agents could be improved by the addition of TEC.

Example 16 and Comparative Example C-13

In example 16, an aqueous composition containing PM 4700 (3% solids) and 5% TEC was sprayed onto 100% cotton print fabric, with a wet pick up of about 50%. Comparative example C-13 was made in the same way but without addition of TEC. The treated substrates were dried at 21° C. during 24 hours and tested for the performance. The results are given in table 4.

TABLE 4 performance of 100% cotton fabric treated with fluorochemical composition.

| Ex No | % TEC | OR | WR |
|---|---|---|---|
| 16 | 5 | 5 | 8 |
| C-13 | 0 | 0 | 2 |

The results indicated that the addition of TEC to an aqueous fluorochemical treating composition significantly improved the performance of textile substrates treated therewith.

Example 17 and Comparative Example C-14

In example 17, an aqueous composition containing PM 4700 (3% solids) and 5% TEC was brush coated onto porous terracotta tiles. Comparative example C-14 was made in the same way, but without addition of TEC. The treated tiles were dried at 21° C. during 48 hours and tested for oil and water repellency.

The results are given in table 5.

TABLE 5 performance of terracotta tiles

| Ex No | % TEC | OR | WR |
|---|---|---|---|
| 17 | 5 | 6 | 8 |
| C-14 | 0 | 1 | 0 |

The results indicated that the addition of TEC to aqueous fluorochemical treating compositions significantly improved the performance of terracotta tiles treated therewith.

Examples 18 to 23 and Comparative Examples C-15 to C-19

In examples 18 to 23 and comparative examples C-15 to C-19, non-dyed full grain cow hide substrates were sprayed with aqueous compositions of PM 4700 (3% solids) containing various amounts of additives as given in table 6. Examples 18 to 21 and comparative examples C-15 to C-18 were made at 110 g/m$^2$; examples 22 and 23 and comparative example C-19 were made at 220 g/m$^2$. The samples were dried at 21° C. during 24 hours and tested for their performance. The results are given in table 6

TABLE 6

| Ex No | Additive (%) | WR | OR |
|---|---|---|---|
| 18 | TBC (1%) | 10 | 6 |
| 19 | TBC (2%) | 10 | 6 |
| 20 | TBC (5%) | 9 | 4 |
| 21 | DBM (5%) | 10 | 5-6 |
| 22 | DBT (5%) | 10 | 6 |
| 23 | TEC (5%) | 10 | 6 |
| C-15 | DIPT (5%) | 2 | 2 |
| C-16 | TMC (5%) | 2 | 2 |
| C-17 | DEM (5%) | 2 | 2 |
| C-18 | GDM (5%) | 2 | 2 |
| C-19 | DTPnB (5%) | 4 | 2-3 |

The data indicated that leather substrates treated with aqueous fluorochemical compositions comprising additives according to the present invention had improved oil and water repellency properties.

Examples 24 to 29 and Comparative Example C-20

In examples 24 to 29, blue nubuck leather samples (available from TFL) were sprayed at 110 g/m$^2$ with aqueous compositions containing PM 4700 (3% solids) and ester derivatives as given in table 7. Comparative example C-20 was made with PM 4700 (3% solids), without ester derivatives. The treated leather samples were dried at 21° C. during 24 hours. The results of oil and water repellency are given in table 7.

TABLE 7

| | | oil and water repellency on full grain leather | | | | |
|---|---|---|---|---|---|---|
| Ex no | Ester derivative (%) | OR | WR | AOR | AWR | SR |
| 24 | TEC (5%) | 6 | 9 | 6 | 8 | 100 |
| 25 | TBC (0.5%) | 4 | 7 | 4 | 7 | 70 |
| 26 | TBC (1%) | 6 | 8 | 5 | 8 | 80 |
| 27 | TBC (2%) | 6 | 9 | 5 | 8 | 80 |
| 28 | ATEC (2%) | 6 | 8 | 5 | 7 | 70 |

TABLE 7-continued

| | | oil and water repellency on full grain leather | | | | |
|---|---|---|---|---|---|---|
| Ex no | Ester derivative (%) | OR | WR | AOR | AWR | SR |
| 29 | ATBC (2%) | 5 | 7 | 5 | 7 | 80 |
| C-20 | / | 1 | 2 | 2 | 2 | 70 |

The results indicated that in all cases, improved repellency properties could be obtained when substrates were treated with a composition according to the invention.

The invention claimed is:

1. An aqueous composition comprising (i) a fluorochemical compound and (ii) an ester derivative of an alpha-hydroxy acid, said ester derivative being chosen from the group consisting of triethyl citrate, tributyl citrate, dibutyl malate, dibutyl tartarate, acetyl triethyl citrate, and acetyl tributyl citrate, and mixtures thereof; wherein said fluorochemical compound comprises a copolymer comprising (a) fluorinated monomer and (b) a non-fluorinated comonomer, said fluorinated monomer being selected from the group consisting of:

fluorinated monomer according to the formula $R_f$—X-L, wherein $R_f$ represents a perfluorinated aliphatic group, X represents an organic linking group and E represents an ethylenically unsaturated group;

fluorinated monomer according to the formula $R^1_f$—$X^1$—OC(O)—C(R)=$CH_2$, wherein $R^1_f$ represents a perfluorinated aliphatic group, $X^1$ is an organic divalent linking group, and R represents hydrogen or a lower alkyl group having 1 to 4 carbon atoms;

and mixtures thereof.

2. An aqueous composition according to claim 1 wherein said ester derivative has a boiling point at 1 atm of at least 150° C.

3. An aqueous composition according to claim 1 wherein said fluorochemical compound is comprised in said aqueous composition in an amount of 1 to 30% by weight and said ester derivative in an amount of 0.1 to 20% by weight.

4. An aqueous composition according to claim 1 wherein the perfluorinated aliphatic group of said fluorinated monomer has 3 or 4 carbon atoms.

5. Method of treatment comprising contacting a substrate with an aqueous composition of claim 1.

6. Method according to claim 4 wherein said method further comprises drying the treated substrate at a temperature of not more than 40° C.

7. Method according to claim 4 wherein said substrate is a fibrous substrate.

8. Method according to claim 4 wherein said substrate is contacted with said aqueous composition by spraying, wiping, brushing or foaming the composition on the substrate.

9. Method according to claim 4 wherein said substrate comprises leather or textile.

10. Spray can comprising an aqueous composition of claim 1.

* * * * *

UNITED STATES PATENT AND TRADEMARK OFFICE

CERTIFICATE OF CORRECTION

PATENT NO. : 7,723,417 B2
APPLICATION NO. : 10/808902
DATED : May 25, 2010
INVENTOR(S) : Dirk Coppens It is certified that error appears in the above-identified patent and that said Letters Patent is hereby corrected as shown below:

Column 7
Line 23; Delete "α,α dimethyl" and insert -- α,α-dimethyl --, therefor.

Column 15
Line 16; Delete "6" and insert -- 6. --, therefor.

Column 16
Line 23; Claim 1, delete "$R_1$—X-L," and insert -- $R_1$—X-E, --, therefor.
Line 45; Claim 6, delete "claim 4" and insert -- claim 5 --, therefor.
Line 48; Claim 7, delete "claim 4" and insert -- claim 5 --, therefor.
Line 50; Claim 8, delete "claim 4" and insert -- claim 5 --, therefor.
Line 53; Claim 9, delete "claim 4" and insert -- claim 5 --, therefor.

Signed and Sealed this
Twenty-seventh Day of November, 2012

David J. Kappos

David J. Kappos
*Director of the United States Patent and Trademark Office*